US011373783B1

(12) United States Patent
McNutt et al.

(10) Patent No.: US 11,373,783 B1
(45) Date of Patent: Jun. 28, 2022

(54) HYBRID CABLES FOR USE WITH SENSITIVE DETECTORS

(71) Applicant: Superior Essex International LP

(72) Inventors: Christopher W. McNutt, Woodstock, GA (US); Amir Sekhavat, Marietta, GA (US); Nathan Spare, Ellinwood, KS (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 17/168,253

(22) Filed: Feb. 5, 2021

(51) Int. Cl.

| | |
|---|---|
| ***H01B 11/08*** | (2006.01) |
| ***H01B 1/02*** | (2006.01) |
| ***H01B 9/02*** | (2006.01) |
| ***H01B 9/00*** | (2006.01) |
| ***H01B 3/44*** | (2006.01) |

(52) U.S. Cl.
CPC ..... *H01B 11/08* (2013.01); *H01B 1/02* (2013.01); *H01B 3/44* (2013.01); *H01B 9/003* (2013.01); *H01B 9/02* (2013.01)

(58) Field of Classification Search
CPC ..... H01B 1/02; H01B 7/02–708; H01B 7/34; H01B 3/44; H01B 9/02–9/08; H01B 9/003; H01B 11/02–11/08
USPC ..... 174/110 R–110 PM, 112, 113 R, 102 R, 174/108, 109
See application file for complete search history.

(56) References Cited

U.S. PATENT DOCUMENTS

| | | | | |
|---|---|---|---|---|
| 6,448,500 | B1 * | 9/2002 | Hosaka | H01B 9/003 174/113 R |
| 6,687,437 | B1 * | 2/2004 | Starnes | G02B 6/4416 385/101 |
| 7,304,241 | B2 * | 12/2007 | Trieb | H01R 13/65912 174/81 |
| 9,508,467 | B2 * | 11/2016 | Pon | H01B 9/003 |
| 2004/0040436 | A1 * | 3/2004 | Aizawa | F16J 9/22 92/172 |
| 2010/0051318 | A1 * | 3/2010 | Wang | H01B 11/12 174/113 R |
| 2011/0162866 | A1 * | 7/2011 | Masakazu | H01B 11/002 174/103 |
| 2016/0020002 | A1 * | 1/2016 | Feng | H01B 11/20 174/103 |

* cited by examiner

*Primary Examiner* — William H. Mayo, III

(57) ABSTRACT

A hybrid cable for use with sensitive detectors may include a central power delivery component, a data delivery component positioned around the power delivery component, and a jacket formed around the power delivery component and the data delivery component. The power delivery component may include a plurality of shielded first individually insulated conductors. The data delivery component may include four twisted pairs of second individually insulated conductors and respective shield layers formed around each of the four pairs. An outer diameter of the cable may be less than 8.5 mm, and the cable may be capable of transmitting data within an operating frequency range of up to 2.5 GHz over a distance of at least 100 m.

20 Claims, 1 Drawing Sheet

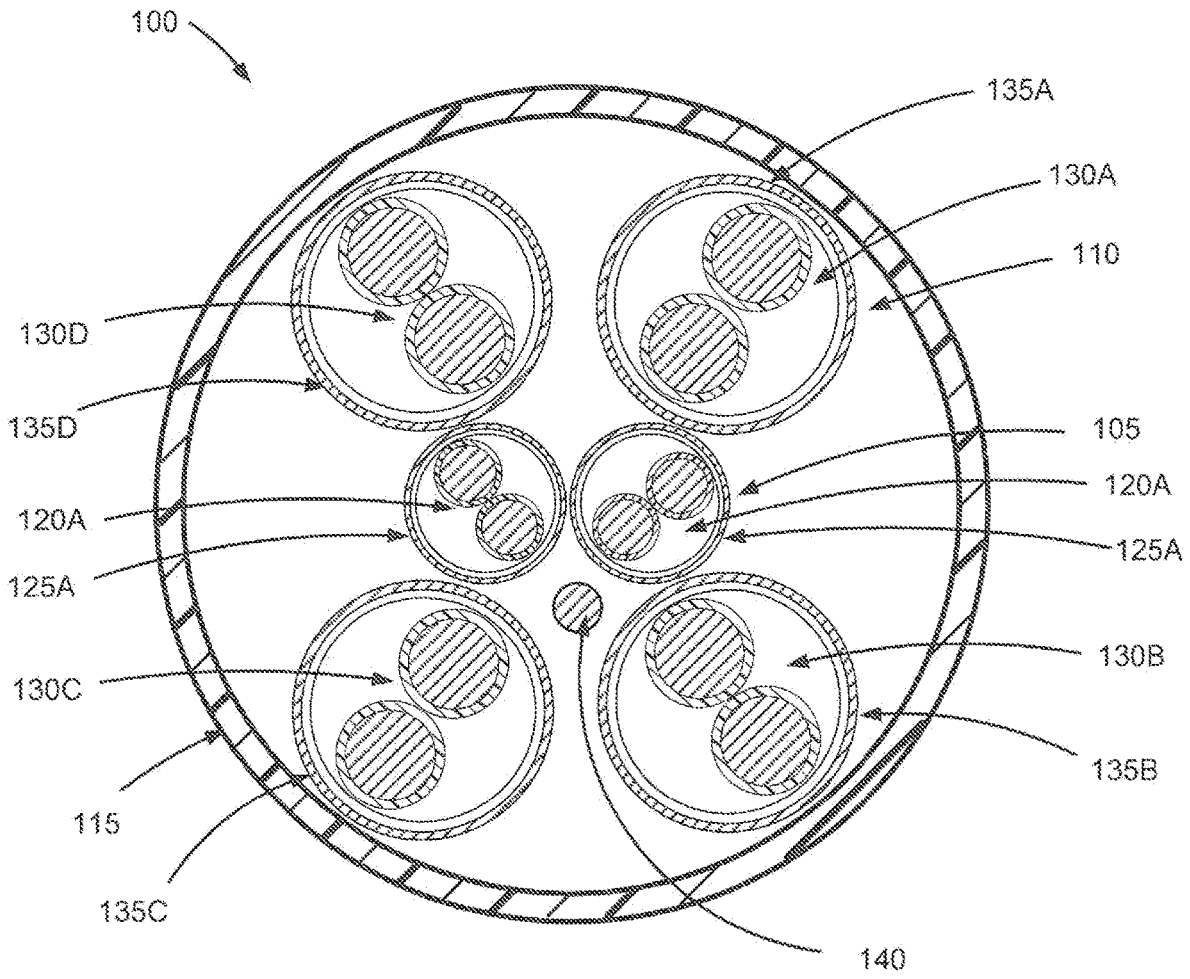
100
135A
130A
110
130D
135D
105
120A
120A
125A
125A
130B
130C
135B
115
135C
140

HYBRID CABLES FOR USE WITH SENSITIVE DETECTORS

TECHNICAL FIELD

Embodiments of the disclosure relate generally to conductive cables and, more particularly, to hybrid cables configured to transmit power and data to sensitive detectors and sensing equipment.

BACKGROUND

Cables are utilized in a wide variety of sensing applications in order to provide power and/or data signals to various detectors, sensing devices, and/or sensing equipment. As new types of detectors are developed, there is a need for cables suitable for connecting these detectors to computing and other devices. For example, there have been recent developments in sensing devices utilized to detect and observe neutrinos. Attempts were first made to transmit data to and from these sensing devices utilizing optical fibers. However, the mechanical connections of the optical fibers were found to lead to faulty data transmission and erroneous measurements by the sensing devices. For example, less than perfect core alignment and intimacy of the optical fibers led to instability in the optical fibers and permitted light signals to jump out of the fiber cores. Accordingly, there is an opportunity for improved cables suitable for use with sensitive detectors, such as detectors utilized to detect neutrinos. Additionally, there is an opportunity for improved hybrid cables suitable for transmission of power and data signals to such sensitive detectors.

BRIEF DESCRIPTION OF THE DRAWINGS

The detailed description is set forth with reference to the accompanying figures. In the figures, the left-most digit(s) of a reference number identifies the FIGURE in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

FIG. 1 is a cross-sectional view of an example hybrid cable suitable for use with relatively sensitive detectors and/or detection devices, according to an illustrative embodiment of the disclosure.

DETAILED DESCRIPTION

Various embodiments of the present disclosure are directed to hybrid cables that include both a power delivery component and a data delivery component. In one example embodiment, the power delivery component may include a plurality of first individually insulated conductors that are configured to transmit a suitable or desired power signal via the cable. According to an aspect of the disclosure, the conductors of the power delivery component may be shielded conductors. The one or more data delivery components may include any suitable number of twisted pairs of second individually insulated conductors. The twisted pairs of the data delivery component may be configured to transmit data signals within a desired frequency operating range. For example, the twisted pairs of the data delivery component may be configured to transmit data signals up to 2.5 GHz over a distance of at least 100 m. A jacket may then be formed around the power delivery component and the data delivery component.

The power delivery component may include any suitable number of first individually insulated conductors. In certain embodiments, the plurality of conductors may include any suitable number of twisted pairs of conductors. For example, the power delivery component may include two twisted pairs of individually insulated conductors. The conductors may be formed with any suitable size or gauge. For example, the conductors may be formed as 26 AWG conductors. Additionally, in certain embodiments, the conductors may be formed as stranded conductors that include a plurality of stranded wires or components. A wide variety of suitable materials, such as fluorinated ethylene propylene ("FEP"), may be utilized to form the insulation around the conductors of the power delivery component. Additionally, any suitable number of shield layers may be incorporated into the power delivery component. For example, a respective shield layer may be formed around each of the twisted pairs of the power delivery component.

The data delivery component may include any suitable number of twisted pairs of second individually insulated conductors. For example, the data delivery component may include four twisted pairs. In certain embodiments, respective individual shield layers may be provided for each of the twisted pairs included in the data delivery component. Additionally, the conductors of the twisted pairs may be formed with any suitable size or gauge. For example, the conductors may be formed as 23 AWG conductors. Additionally, in certain embodiments, the conductors may be formed as solid conductors (e.g., solid annealed copper conductors, etc.) in order to enhance or improve the integrity of connections between the conductors and connected devices (e.g., sensing devices, etc.). A wide variety of suitable materials, such as fluorinated ethylene propylene ("FEP"), may be utilized to form the insulation around the conductors of the data delivery component. In certain embodiments, the twist lays of the twisted pairs may be selected and/or formed in order to permit the twisted pairs to transmit data within the desired operating frequency range (e.g., up to 2.5 GHz for at least 100 m). Additionally, in certain embodiments, the twist lays may be selected and/or formed in order to permit the cable to satisfy the electrical performance criteria of one of more suitable standards, such as a Category 6A standard.

The shield layers incorporated into the cable, such as the shield layers incorporated into the power delivery component and/or the data delivery component, may be formed with a wide variety of suitable constructions. In certain embodiments, each shield layer may include a base dielectric layer and a shielding layer formed on the base dielectric layer. The dielectric layer may be formed from a wide variety of suitable materials, such as polyethylene terephthalate ("PET"). Additionally, a wide variety of suitable materials may be utilized to form a shielding layer, such as suitable metallic materials that provide electromagnetic interference ("EMI") shielding. In certain embodiments, a shielding layer may include aluminum that spans in a continuous manner (i.e., without dielectric gaps formed between separate patches) along a longitudinal direction. As desired, one or more drain wires may be incorporated into the cable.

In certain embodiments, the power delivery component may be positioned or arranged as a central component within the cable. The twisted pairs of the data delivery component may then be positioned around an outer periphery of the power delivery component. In this regard, an outer diameter of the cable may be reduced or minimized. In certain embodiments, the cable may have an outer diameter of less than approximately 8.5 mm. As a result, the cable may be routed through and/or installed in relatively small ducts, conduit, and/or other locations.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIG. 1, a cross-section of an example hybrid cable 100 suitable for use with relatively sensitive detectors and/or sensing devices is illustrated. The cable 100 may be utilized in association with a wide variety of suitable detectors, sensing devices, and/or other devices. For example, the cable 100 may be utilized in association with sensing devices configured to detect, observe, and/or monitor neutrinos. The cable 100 may include a power delivery component 105, a data delivery component 110, and a jacket 115. The power delivery component 105 may include a plurality of first conductors suitable for transmitting a power signal over the cable 100. The data delivery component 110 may include a plurality of twisted pairs of second conductors suitable for transmitting data signals over the cable within a desired frequency operating range. The jacket 115 may be formed around the power delivery component 105, the data delivery component 110, and any other internal components of the cable 100. Each of these components is described in greater detail below.

The power delivery component 105 may include any suitable number of first individually insulated conductors or first conductive components configured to transmit one or more desired power signals over the cable 100. In certain embodiments, and as shown in FIG. 1, the power delivery component 105 may include four individually insulated first conductors. In other embodiments, the power delivery component 105 may include other suitable numbers of first conductors. For example, the power delivery component 105 may include 2, 3, 4, 6, 8, or any other suitable number of first conductors. Additionally, the first conductors may be formed with any suitable sizes, gauges, cross-sectional areas, and/or other dimensions. In certain embodiments, the first conductors may be 26 AWG conductors. In other embodiments, the first conductors may be 18 AWG, 20 AWG, 22 AWG, 23 AWG, 24 AWG, 25 AWG, 26 AWG, 27 AWG, or 28 AWG conductors. Additionally, in various embodiments, the conductors may have diameters of approximately 0.812 mm, 0.644 mm, 0.573 mm, 0.511 mm, 0.455 mm, 0.405 mm, 0.361 mm, a diameter included in a range between any two of the above values, or a diameter included in a range bounded on either a minimum or maximum end by one of the above values. In certain embodiments, the plurality of first conductors included in the power delivery component 105 may be arranged or positioned into one or more twisted pairs of conductors. For example, as shown in FIG. 1, the power delivery component 105 may include two twisted pairs 120A, 120B of individually insulated first conductors. Other suitable number of twisted pairs may be utilized in other embodiments.

As desired, the number and/or sizes of the first conductors may be selected in order to satisfy a desired power delivery requirement or parameters for the cable 100. For example, the number and/or sizes of the first conductors may be selected to deliver a desired amount of power to a detector or other device. The first conductor sizes may also be optimized in order to deliver a desired amount of power over a desired distance with an acceptable or desired voltage drop (i.e., a very low voltage drop). In certain embodiments, the power delivery component 105 and the first conductors may be formed from materials and/or may be sized to facilitate the efficient transmission of a desired power signal. For example, the first conductors may be formed and/or sized to have a desired resistance, such as a resistance between approximately 6.30 ohms per 1000 feet and approximately 64.90 ohms per 1000 feet at a temperature of approximately twenty degrees Celsius (20° C.).

Each of the first conductors included in the power delivery component 105 may be formed from any suitable electrically conductive material, as copper, aluminum, silver, annealed copper, gold, a conductive alloy, etc. Further, each of the first conductors may be formed as either a solid conductor or as a conductor that includes a plurality of conductive strands that are twisted together. In certain embodiments, the first conductors of the power delivery component 105 may be formed as stranded copper conductors. Any suitable number of strands may be incorporated into a stranded conductor, and the strands may be formed with any suitable sizes. For example, a 26 AWG conductor may be formed from seven 34 AWG strands. The use of stranded conductors may enhance the flexibility of the first conductors and the overall cable 100. Additionally, the use of stranded conductors may result in the first conductors being less sensitive to power transfer deviations and losses along the conductors due to straining of the copper when the cable 100 is bent or flexed.

The first conductors of the power delivery component 105 may include insulation formed from any suitable dielectric materials and/or combination of materials. Examples of suitable dielectric materials include, but are not limited to, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins, a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. In various embodiments, first conductor insulation may be formed from one or multiple layers of insulation material. A layer of insulation may be formed as solid insulation, unfoamed insulation, foamed insulation, or other suitable insulation. As desired, a combination of different types of insulation may be utilized. For example, a foamed insulation layer may be covered with a solid foam skin layer. As desired in certain embodiments, insulation may additionally include a wide variety of other materials (e.g., filler materials, materials compounded or mixed with a base insulation material, etc.), such as smoke suppressant materials, flame retardant materials, etc.

Additionally, in certain embodiments, the insulation of each of the first conductors may be formed from similar materials. In other embodiments, at least two of the first conductors may utilize different insulation materials. In one example embodiment, the insulation for each of the first conductors included in the power delivery component 105 may be formed from or may include FEP. For example, the first conductors may be insulated with solid FEP insulation. FEP exhibits relatively high hydrophobicity, relatively high chemical resistance, excellent dielectric properties, excellent flame retardancy, and may exhibit little to no dielectric property and/or thermal degradation change over time. As a result, the use of FEP may ensure consistent cable performance over time and in various environmental conditions. Additionally, the insulation may be formed with any suitable thickness, inner diameter, outer diameter, and/or other dimensions. For example, the insulation may have a thickness between approximately 0.003 inches (0.076 mm) and approximately 0.08 inches (0.203 mm). In various embodiments, the insulation may have a thickness of approximately 0.003 inches (0.0762 mm), 0.004 inches (0.102 mm), 0.005 inches (0.127 mm), 0.006 inches (0.1524 mm), 0.008 inches (0.203 mm), 0.01 inches (0.254 mm), 0.012 inches (0.304 mm), 0.013 inches (0.3302 mm), 0.014 inches (0.3556 mm), 0.015 inches (0.381 mm), 0.016 (0.4064 mm), 0.018 (0.4572 mm), 0.02 inches (0.508 mm), a thickness included in a range between any two of the above values, or a thickness included in a range bounded on either a minimum or maximum end by one of the above values.

In certain embodiments, the first conductors of the power delivery component 105 may be stranded together. For example, the plurality of first conductors may be helically twisted or stranded together. As another example, as shown in FIG. 1, the first conductors may be arranged into any suitable number of twisted pairs, such as pairs 120A, 120B. Each of the twisted pairs (generally referred to as twisted pair 120) may include two conductors that are twisted together with any suitable twist lay or lay length. For example, the conductors of a twisted pair 120 may be twisted with a lay length (e.g., a left-hand or counterclockwise lay, etc.) of approximately 1.00 inches (2.54 cm). In other embodiments, the conductors of a twisted pair 120 may have a lay length of approximately 0.60, 0.75, 0.80, 1.00, 1.20, 1.25, 1.40, 1.50, 1.60, 1.80, or 2.00 inches, a lay length included in a range between any two of the above values, or a lay length included in a range bounded on either a minimum or maximum end by one of the above values. Other suitable lay lengths may be utilized as desired. In certain embodiments, a plurality of twisted pairs 120A, 120B included in the power delivery component 105 may have similar twist lays. For example, each of the twisted pairs 120A, 120B may have a twist lay of approximately 4.60 inches. In other embodiments, at least two twisted pairs included in the power delivery component 105 may have different twist lays.

As desired, a plurality of twisted pairs included in the power delivery component 105 may be stranded or twisted together. For example, the two twisted pairs 120A, 120B illustrated in FIG. 1 may be twisted together with any suitable bunch lay. A wide variety of suitable bunch lays may be utilized as desired in various embodiments. In one example embodiment, the plurality of twisted pairs 120A, 120B may be twisted together with a bunch lay of approximately 4.60 inches (11.684 cm). In other embodiments, the twisted pairs 120A, 120B may be twisted together with a bunch lay of approximately 2.50, 2.75, 3.00, 3.25, 3.50, 3.75, 4.00, 4.25, 4.50, 4.60, 4.75, 5.00, 5.25, or 5.50 inches, a bunch lay included in a range between any two of the above values, or a bunch lay included in a range bounded on either a minimum or maximum end by one of the above values. Additionally, in certain embodiments, the bunch lay may be formed in a different direction than the twist direction of the twisted pairs 120A, 120B. For example, each of the twisted pairs 120A, 120B may be formed with a left-hand or counterclockwise lay, and the plurality of twisted pairs 120A, 120B may have a bunch lay formed in a right-hand or clockwise direction. In other embodiments, the pairs 120A, 120B may have twist lays formed in the same direction as a bunch lay for the plurality of pairs. In yet other embodiments, at least two twisted pairs included in the power delivery component 105 may be twisted in opposite directions, and the bunch lay may then be formed in either a clockwise or counterclockwise direction.

According to an aspect of the disclosure, the first conductors of the power delivery component 105 may be shielded conductors. In other words, one or more suitable shield layers may be incorporated into the power delivery component 105 to provide electromagnetic interference shielding between the first conductors and other components of the cable (e.g., second conductors included in the data delivery component 110, etc.). Any number of suitable shielding layers or shields may be incorporated into the power delivery component 105 as desired in various embodiments. For example, an overall shield may be formed around the plurality of first conductors. As another example, individual shields may be provided for each of the first conductors. As yet another example, shields may be formed around various subsets or groupings of the first conductors. In certain embodiments, as illustrated in FIG. 1, respective shield layers 125A, 125B may be provided for each of the twisted pairs 120A, 120B of first conductors included in the power delivery component 105. In other words, a first shield layer 125A may be formed around a first twisted pair 120A, and a second shield layer 125B may be formed around a second twisted pair 120B.

Each shield layer or shield (generally referred to as shield layer 125) may be formed with any suitable construction. In certain embodiments, a shield layer 125 may be formed as a tape that includes both a dielectric layer and a layer of shielding material (e.g., copper, aluminum, silver, an alloy, etc.) formed on one or both sides of the dielectric layer. A wide variety of suitable techniques and/or processes may be utilized to form a shield 125. For example, a base material or dielectric material may be extruded, pultruded, or otherwise formed. Electrically conductive material or other shielding material may then be applied to the base material. In certain embodiments, the base layer may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer.

Examples of suitable materials that may be used to form a dielectric layer include, but are not limited to, various plastics, one or more polymeric materials, polyethylene terephthalate ("PET"), one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, aramid materials, or dielectric material(s) that does not ordinarily conduct electricity. In certain embodiments, a separate dielectric layer and layer of shielding material may be bonded, adhered, or otherwise joined (e.g., glued, etc.) together to form the shield 125. In other embodiments, a layer of shielding material may be formed on a dielectric layer via any number of suitable techniques, such as the application of metallic ink or paint, liquid metal deposition, vapor deposition, welding, heat fusion, etc. In certain embodiments, the layer of shielding material can be over-coated with an electrically insulating film, such as a polyester coating. Additionally, in certain embodiments, a layer of shielding material may be sandwiched between two dielectric layers. In other embodiments, at least two layers of shielding material may be combined with any number of suitable dielectric layers to form the shield 125. Indeed, any number of suitable layers of material may be utilized and combined together in order to form a shield 125.

A wide variety of suitable shielding materials may be utilized to form a layer of shielding material. Examples of suitable electrically conductive materials that may be utilized include, but are not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. As desired, electrically conductive material utilized to form a layer of shielding material may have any desired thickness. For example, electrically conductive material may have a thickness of approximately 0.5 mils (about 13 microns) or greater. In other embodiments, electrically conductive material may have a thickness of approximately 0.5 mils, 1.0 mil (25.4 microns), 1.5 mils (38.1 microns), 2.0 mils (50.8 microns), 225 mils (57.2 mils), 2.5 mils (63.5 mils), 3.0 mils (76.2 microns), a thickness included in a range between any two of the above values, or a thickness included in a range bounded on a minimum end by one of the above values. In some applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. A greater thickness may limit negative insertion loss characteristics.

In certain embodiments, the electrically conductive material or other shielding material incorporated into a shield 125 may be relatively continuous along a longitudinal length of the shield 125 and the cable 100. For example, a relatively continuous foil shield or foil shield layer may be utilized. In other embodiments, a shield 125 may be formed as a discontinuous shield element having a plurality of isolated patches of shielding material. For example, a plurality of discontinuous patches of electrically conductive material may be incorporated into the shield 125, and gaps or spaces may be present between adjacent patches in a longitudinal direction. A wide variety of different patch patterns may be formed as desired in various embodiments, and a patch pattern may include a period or definite step. In other embodiments, patches may be randomly formed or situated on a base or carrier layer.

In one example embodiment, a shield 125 may include a base dielectric layer formed from PET. A longitudinally continuous aluminum layer of shielding material may then be formed on or adhered to the base dielectric layer. Additionally, in certain embodiments, a plurality of shield layers (e.g., shield layers 125A, 125B, etc.) incorporated into the power delivery component 105 may be formed with similar constructions. In other embodiments, at least two shield layers incorporated into the power delivery component 105 may have different constructions.

With continued reference to FIG. 1, in certain embodiments, the power delivery component 105 may be positioned as a central component of the cable 100. For example, the power delivery component 105 may be positioned along or proximate to a longitudinally extending cross-sectional center line of the cable 100. The data delivery component 110 may then be positioned around the power delivery component 105. For example, a plurality of twisted pairs of second individually insulated conductors included in the data delivery component 110 may be positioned around the power delivery component 105. As a result of centrally positioning the power delivery component 105, it may be possible to form the cable 100 with a smaller overall or outer diameter. In this regard, the cable 100 may be routed through and/or positioned in smaller ducts, conduit, and/or other places. In other embodiments, the power delivery component 105 and the data delivery component 110 may be positioned in other arrangements or configurations, such as a side by side arrangement.

With continued reference to FIG. 1, the data delivery component 110 may include any suitable number of second individually insulated conductors or second conductive components configured to transmit one or more desired data signals over the cable 100. In certain embodiments, the data delivery component 110 may include a plurality of twisted pairs of second individually insulated conductors. For example, as shown in FIG. 1, the data delivery component 110 may include four twisted pairs of individually insulated conductors 130A, 130B, 130C, 130D. In other embodiments, the data delivery component 110 may include other suitable numbers of twisted pairs and/or other arrangements of second conductors. Each twisted pair (generally referred to as twisted pair 130) may include two electrical conductors, and each conductor may be covered with respective insulation.

Each of the second conductors included in the data delivery component 110 (i.e., the conductors included in each of the twisted pairs 130A-D, etc.) may be formed from any suitable electrically conductive material, as copper, aluminum, silver, annealed copper, gold, a conductive alloy, etc. Further, each of the second conductors may be formed as either a solid conductor or as a conductor that includes a plurality of conductive strands that are twisted together. In certain embodiments, the second conductors of the data delivery component 110 may be formed as solid annealed copper conductors. The use of solid conductors may enhance or improve the integrity of connections to sensing devices or other suitable devices connected to the cable 100. By contrast, stranded conductors may have issues with connector integrity as the stranded conductors have an easily collapsible or formable construction.

Additionally, the second conductors may be formed with any suitable sizes, gauges, cross-sectional areas, and/or other dimensions. In certain embodiments, the first conductors may be 23 AWG conductors. In other embodiments, the first conductors may be 20 AWG, 22 AWG, 23 AWG, or 24 AWG conductors. Additionally, in various embodiments, the conductors may have diameters of approximately 0.812 mm, 0.644 mm, 0.573 mm, 0.511 mm, a diameter included in a range between any two of the above values, or a diameter included in a range bounded on either a minimum or maximum end by one of the above values.

The second conductors of the data delivery component 110 may include insulation formed from any suitable dielectric materials and/or combination of materials. Examples of suitable dielectric materials include, but are not limited to, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins, a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. In various embodiments, second conductor insulation may be formed from one or multiple layers of insulation material. A layer of insulation may be formed as solid insulation, unfoamed insulation, foamed insulation, or other suitable insulation. As desired, a combination of different types of insulation may be utilized. For example, a foamed insulation layer may be covered with a solid foam skin layer. As desired in certain embodiments, insulation may additionally include a wide variety of other materials (e.g., filler materials, materials compounded or mixed with a base insulation material, etc.), such as smoke suppressant materials, flame retardant materials, etc.

Additionally, in certain embodiments, the insulation of each of the second conductors may be formed from similar materials. For example, the conductors of each of the twisted pairs 130A-D may include similar insulation. In other embodiments, the conductors of at least two of the twisted pairs 130A-D may utilize different insulation materials. In yet other embodiments, the individual conductors within at least one twisted pair (e.g., twisted pair 130A, etc.) may utilized different insulation materials. Indeed, a wide variety of combinations and configurations of insulation materials may be utilized. In one example embodiment, the insulation for each of the second conductors included in the data delivery component 110 (e.g., the conductors for each of the twisted pairs 130A-D, etc.) may be formed from or may include FEP. For example, the second conductors may be insulated with solid FEP insulation. FEP exhibits relatively high hydrophobicity, relatively high chemical resistance, excellent dielectric properties, excellent flame retardancy, and may exhibit little to no dielectric property and/or thermal degradation change over time. As a result, the use of FEP may ensure consistent cable performance over time and in various environmental conditions. Additionally, the insulation may be formed with any suitable thickness, inner diameter, outer diameter, and/or other dimensions. For example, the insulation may have a thickness between approximately 0.01 inches (0.254 mm) and approximately 0.02 inches (0.508). In various embodiments, the insulation may have a thickness of approximately 0.01 inches (0.254 mm), 0.012 inches (0.304 mm), 0.013 inches (0.3302 mm), 0.014 inches (0.3556 mm), 0.015 inches (0.381 mm), 0.016 (0.4064 mm), 0.018 (0.4572 mm), 0.02 inches (0.508 mm), a thickness included in a range between any two of the above values, or a thickness included in a range bounded on either a minimum or maximum end by one of the above values.

Each of the twisted pain 130A-D included in the data delivery component 110 can carry data or some other form of information, for example in a range of about one to ten Giga bits per second ("Gbps") or other suitable data rates, whether higher or lower. In certain embodiments, each twisted pair 130 supports data transmission of about two and one-half Gbps (e.g. nominally two and one-half Gbps), with the cable 100 supporting about ten Gbps (e.g. nominally ten Gbps). In certain embodiments, each twisted pair 130 supports data transmission of up to about ten Gbps (e.g. nominally ten Gbps), with the cable 100 supporting about forty Gbps (e.g. nominally forty Gbps).

According to an aspect of the disclosure, a desired number of the twisted pairs may be formed with different respective twist lays. For example, in the illustrated cable 100, each of the twisted pairs 130A-D of the data delivery component 110 may have a different twist lay. The different twist lays may function to reduce crosstalk between the twisted pairs 130A-D, and a wide variety of suitable twist lay configurations may be utilized. According to an aspect of the disclosure, the respective twist lays for the twisted pairs 130A-D may be selected, calculated, or determined in order to result in a cable 100 that satisfies one or more desired operating frequency ranges, standards and/or electrical requirements. For example, twist lays may be selected such that the data delivery component 110 and the cable 100 are capable of transmitting data in a frequency range of up to 2.5 GHz over a distance of at least 100 m. As another example, twist lays may be selected such that the data delivery component 110 satisfies one or more electrical requirements of a Category 6A standard, such as the ANSI/TIA 568.2-D standard set forth by the Telecommunications Industry Association in September 2018. As desired, twist lays may also be selected to satisfy any other suitable performance requirements, such as propagation delay skew requirements.

In certain embodiments, each of the twisted pairs 130A-D included in the data delivery component 110 may have a twist lay included in a range between approximately 0.25 inches and approximately 6.0 inches. For example, each of the twisted pairs 130A-D may have a different twist lay with each respective twist lay being between approximately 0.584 inches and approximately 1.124 inches. A wide variety of suitable ranges of twist lays may be utilized as desired. In various embodiments, a minimum value for a twist lay range may be approximately 0.25, 0.30, 0.35, 0.40, 0.45, 0.50, 0.55, 0.584, 0.60, 0.65, 0.70, and 0.75 inches. A maximum value for a twist lay range may be approximately 0.80, 0.85, 0.90, 1.0, 1.05, 1.10, 1.124, 1.30, 1.50, 1.75, 1.80, 2.0, 2.5, 3.0 3.5, 4.0, 4.5, 5.0, and 6.0 inches. A suitable twist lay range may be formed using any combination of the minimum or maximum values listed above.

In the example cable 100 of FIG. 1 that includes four twisted pairs 130A-D in the data delivery component 110, a first twisted pair 130A may have a twist lay between approximately 0.584 inches and approximately 0.714 inches; a second twisted pair 130B may have a twist lay between approximately 0.808 inches and approximately 0.988 inches; a third twisted pair 130C may have a twist lay between approximately 0.684 inches and approximately 0.836 inches; and a fourth twisted pair 130D may have a twist lay between approximately 0.920 inches and approximately 1.124 inches. Further, the illustrated positions of the various twisted pairs 130A-D in the cable 100 of FIG. 1 may be varied or modified as desired in various embodiments. In other words, the first twisted pair 130A is not required to be positioned in a top right quadrant, and so on. Additionally, the twisted pairs 130A-D positions relative to one another may be varied or modified as desired.

In certain embodiments, the differences between twist lays of twisted pairs 130A-D that are circumferentially adjacent one another (for example the twisted pair 130A and the twisted pair 130B) may be greater than the differences between twist lays of twisted pairs 130A-D that are diagonal from one another (for example the twisted pair 130A and the twisted pair 130C). As a result of having similar twist lays, the twisted pairs that are diagonally disposed can be more susceptible to crosstalk issues than the twisted pairs that are circumferentially adjacent; however, the distance between the diagonally disposed pairs may limit the crosstalk. Thus, the different twist lays and arrangements of the pairs can help reduce crosstalk among the twisted pairs 130A-D.

According to an aspect of the disclosure, the second conductors of the data delivery component 110 may be shielded conductors. In other words, one or more suitable shield layers may be incorporated into the data delivery component 110 to provide electromagnetic interference shielding for the second conductors of the twisted pairs 130A-D. Any number of suitable shielding layers or shields may be incorporated into the data delivery component 110 as desired in various embodiments. For example, as illustrated in FIG. 1, respective shield layers 135A, 135B, 135C, 135D may be provided for each of the twisted pairs 130A-D of second conductors included in the data delivery component 110. In other words, a first shield layer 135A may be formed around a first twisted pair 130A, and a second shield layer 135B may be formed around a second twisted pair 1308, a third shield layer 135C may be formed around a third twisted pair 130C, and a fourth shield layer 135D may be formed around a fourth twisted pair 130D.

Each shield layer or shield (generally referred to as shield layer 135) may be formed with any suitable construction. In certain embodiments, a shield layer 135 may be formed as a tape that includes both a dielectric layer and a layer of shielding material (e.g., copper, aluminum, silver, an alloy, etc.) formed on one or both sides of the dielectric layer. A wide variety of suitable techniques and/or processes may be utilized to form a shield 135. For example, a base material or dielectric material may be extruded, pultruded, or otherwise formed. Electrically conductive material or other shielding material may then be applied to the base material. In certain embodiments, the base layer may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer.

Examples of suitable materials that may be used to form a dielectric layer include, but are not limited to, various plastics, one or more polymeric materials, polyethylene terephthalate ("PET"), one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, aramid materials, or dielectric material(s) that does not ordinarily conduct electricity. In certain embodiments, a separate dielectric layer and layer of shielding material may be bonded, adhered, or otherwise joined (e.g., glued, etc.) together to form the shield 135. In other embodiments, a layer of shielding material may be formed on a dielectric layer via any number of suitable techniques, such as the application of metallic ink or paint, liquid metal deposition, vapor deposition, welding, heat fusion, etc. In certain embodiments, the layer of shielding material can be over-coated with an electrically insulating film, such as a polyester coating. Additionally, in certain embodiments, a layer of shielding material may be sandwiched between two dielectric layers. In other embodiments, at least two layers of shielding material may be combined with any number of suitable dielectric layers to form the shield 135. Indeed, any number of suitable layers of material may be utilized and combined together in order to form a shield 135.

A wide variety of suitable shielding materials may be utilized to form a layer of shielding material. Examples of suitable electrically conductive materials that may be utilized include, but are not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. As desired, electrically conductive material utilized to form a layer of shielding material may have any desired thickness. For example, electrically conductive material may have a thickness of approximately 0.5 mils (about 13 microns) or greater. In other embodiments, electrically conductive material may have a thickness of approximately 0.5 mils, 1.0 mil (25.4 microns), 1.5 mils (38.1 microns), 2.0 mils (50.8 microns), 225 mils (57.2 mils), 2.5 mils (63.5 mils), 3.0 mils (76.2 microns), a thickness included in a range between any two of the above values, or a thickness included in a range bounded on a minimum end by one of the above values. In some applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. A greater thickness may limit negative insertion loss characteristics.

In certain embodiments, the electrically conductive material or other shielding material incorporated into a shield 135 may be relatively continuous along a longitudinal length of the shield 135 and the cable 100. For example, a relatively continuous foil shield or foil shield layer may be utilized. In other embodiments, a shield 135 may be formed as a discontinuous shield element having a plurality of isolated patches of shielding material. For example, a plurality of discontinuous patches of electrically conductive material may be incorporated into the shield 135, and gaps or spaces may be present between adjacent patches in a longitudinal direction. A wide variety of different patch patterns may be formed as desired in various embodiments, and a patch pattern may include a period or definite step. In other embodiments, patches may be randomly formed or situated on a base or carrier layer.

In one example embodiment, a shield 135 may include a base dielectric layer formed from PET. A longitudinally continuous aluminum layer of shielding material may then be formed on or adhered to the base dielectric layer. Additionally, in certain embodiments, a plurality of shield layers (e.g., shield layers 135A-D, etc.) incorporated into the data delivery component 110 may be formed with similar constructions. In other embodiments, at least two shield layers incorporated into the data delivery component 110 may have different constructions.

As desired, the plurality of twisted pairs 130A-D included in the data delivery component 110 may be bunched and stranded or twisted together. In certain embodiments, the data delivery component 110 may also be stranded or twisted with the power delivery component 105. For example, the data delivery component 110 and the power delivery component 105 may be positioned adjacent to one another and twisted together. As shown in FIG. 1, in certain embodiments, the twisted pairs 130A-D of the data delivery component 110 may be positioned around an outer periphery of the power delivery component 105, and the twisted pairs 130A-D may be stranded or twisted with the power delivery component 105.

The twisted pairs 130A-D of the data delivery component 110 may be twisted together and/or twisted with the power delivery component 105 with any suitable bunch lay. In the event that the twisted pairs 130A-D are twisted with the power delivery component 105, the first conductors of the power delivery component 105 may be subjected to a plurality of twists (e.g., twists in order to form twisted pairs of first conductors, a first bunching twist for the twisted pairs of first conductors, and a second bunching twist with the twisted pairs of second conductors, etc.) In one example embodiment, the plurality of twisted pairs 130A-D and, as desired, the data delivery component 110 may be twisted together with a bunch lay of approximately 4.60 inches (11.684 cm). In other embodiments, a bunch lay of approximately 2.50, 2.75, 3.00, 3.25, 3.50, 3.75, 4.00, 4.25, 4.50, 4.60, 4.75, 5.00, 5.25, or 5.50 inches, a bunch lay included in a range between any two of the above values, or a bunch lay included in a range bounded on either a minimum or maximum end by one of the above values may be utilized. Additionally, in certain embodiments, the bunch lay may be formed in a different direction than the twist direction of the twisted pairs 130A-D. For example, each of the twisted pairs 130A-D may be formed with a left-hand or counterclockwise lay, and the bunch lay may be formed in a right-hand or clockwise direction. In other embodiments, the pairs 130D-D may have twist lays formed in the same direction as a bunch lay. In yet other embodiments, at least two twisted pairs included in the data delivery component 110 may be twisted in opposite directions, and the bunch lay may then be formed in either a clockwise or counterclockwise direction. As desired in certain embodiments, one or more suitable bindings or wraps may be wrapped or otherwise formed around the twisted pairs 130A-D once they are twisted together and, as desired, twisted with the power delivery component 105.

The example twist lays discussed above for the twisted pairs 130A-D may be initial twist lays for the twisted pairs 130A-D when they are first twisted. In certain embodiments, the final twist lays of the one or more of the twisted pairs 130A-D may be altered or modified by twisting or bunching of the twisted pairs 130A-D. Overall twisting in the same direction as one or more of the twisted pairs 130A-D may result in tightening the initial twist lays of the one or more pairs 130A-D. Conversely, overall twisting in an opposite direction as one or more of the twisted pairs 130A-D may result in loosening the initial twist lays.

With continued reference to FIG. 1, a jacket 115 may enclose the internal components of the cable 100, seal the cable 100 from the environment, and/or provide strength and structural support. The jacket 115 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. As desired in various embodiments, the jacket 115 may be formed as a single layer or, alternatively, as multiple layers. In certain embodiments, the jacket 115 may be formed from one or more layers of foamed material. As desired, the jacket 115 can include flame retardant and/or smoke suppressant materials. In certain embodiments, the jacket 115 may be formed from or may include solid FEP. FEP exhibits relatively high hydrophobicity, relatively high chemical resistance, excellent dielectric properties, excellent flame retardancy, and may exhibit little to no dielectric property and/or thermal degradation change over time. As a result, the use of FEP may ensure consistent cable performance over time and in various environmental conditions.

As shown in FIG. 1, in certain embodiments, the jacket 115 may be formed to result in a round cable or a cable having an approximately circular cross-section. In other embodiments, the jacket 115 and internal components may be formed to result in other desired shapes, such as an elliptical, oval, or rectangular shape. The jacket 115 may also have a wide variety of suitable dimensions, such as any suitable or desirable outer diameter and/or any suitable or desirable wall thickness. In certain embodiments, the jacket 115 may have an outer diameter of less than approximately 8.5 mm. In other embodiments, the jacket 115 may have an outer diameter of less than approximately 7.5, 8.0, 8.25, 8.5, 8.75, 9.0, 9.5, or 10.0 mm, or an outer diameter included in a range between any two of the above values. In certain embodiments, the arrangement or configuration of the twisted pairs 130A-D of the data delivery component 110 around the power delivery component 105 may permit the jacket 115 and the cable 100 to have a relatively small outer diameter, such as an outer diameter of less than approximately 8.5 mm. Additionally, the jacket 115 may be formed with any suitable thickness. In certain embodiments, the jacket 115 may have a nominal thickness of approximately 0.25 mm (about 0.01 inches). Other suitable thicknesses may be utilized as desired in other embodiments.

In various embodiments, the jacket 115 can be characterized as an outer jacket, an outer sheath, a casing, a circumferential cover, or a shell. An opening enclosed by the jacket 115 may be referred to as a cable core, and the power delivery component 105, data delivery component 110, and/or other internal components of the cable 100 may be positioned within the cable core. Although a single cable core is illustrated in the cable 100 of FIG. 1, a cable may be formed to include multiple cable cores. In certain embodiments, the cable core may be filled with a gas such as air (as illustrated) or alternatively a gelatinous, solid, powder, moisture absorbing material, water-swellable substance, dry filling compound, or foam material, for example in interstitial spaces between the internal components. Other elements can be added to the cable core as desired, for example additional electrical conductors, additional twisted pairs, water absorbing materials, and/or strength members, depending upon application goals.

With continued reference to FIG. 1, in certain embodiments, one or more drain wires 140 may be incorporated into the cable 100. For example, one or more tin-coated drain wires 140 may be positioned in the cable core. Each drain wire 140 may be formed from any suitable materials and may have any suitable dimensions. When the cable 100 is installed and terminated, the one or more drain wires may be bonded and grounded. As desired, when the cable 100 is installed, all or a portion of the shield layers 125A-B, 135A-D may also be bonded and grounded.

In certain embodiments, the cable 100 may be engineered, designed, and constructed in order to satisfy any suitable number of electrical performance criteria. For example, a combination of twist lays for the twisted pairs 130A-D of the data delivery component 110, shield layers 125A-B, 135A-D formed around various conductors, and/or materials utilized to form cable components may permit the cable 100 to satisfy desired electrical performance criteria. As a result, the cable 100 may be suitable for use in applications associated with the performance criteria, such as applications in which the cable 100 is utilized in association with sensing devices (e.g., devices that sense and monitor neutrinos, etc.). In certain embodiments, the cable 100 may be capable of facilitating data transmission within a desired operating frequency range. For example, the cable 100 and the twisted pairs 130A-D of the data delivery component 110 may be capable of transmitting data at a frequency of up to 2.5 GHz over a distance of at least 100 m. As another example, the cable 100 may be capable of transmitting data in accordance with one or more suitable industry standards, such as a Category 6A standard.

Additionally, in certain embodiments, it will be appreciated that the cable 100 may be formed with transmission media that only include individually insulated electrical conductors. In other words, in certain embodiments, the cable 100 may be formed without including optical fibers. Additionally, in certain embodiments, the cable 100 may be formed without including coaxial conductors. As desired in other embodiments, other types of transmission media (e.g., optical fibers, etc.) may be incorporated into the cable 100 in addition to the first and second pluralities of individually insulated conductors.

As desired in various embodiments, a wide variety of other materials may be incorporated into the cable 100. For example, as set forth above, a cable may include any number of conductors, twisted pairs, and, in certain embodiments, other transmission media. As desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions, materials, configurations, and/or arrangements than the components illustrated in FIG. 1.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable, comprising:

a central component configured to transmit a power signal, the central component comprising:

two twisted pairs of first individually insulated conductors; and respective first shield layers formed around each of the two pairs of first individually insulated conductors;

four twisted pairs of second individually insulated conductors positioned around an outer periphery of the central component and stranded with the central component, each of the second individually insulated conductors comprising solid copper;

respective second shield layers formed around each of the four pairs of second individually insulated conductors; and a jacket formed around the central component and the four twisted pairs, wherein an outer diameter of the cable is less than 8.5 mm, and wherein the cable is capable of transmitting data within an operating frequency range of up to 2.5 GHz over a distance of at least 100 m.

2. The cable of claim 1, wherein each of the first individually insulated conductors comprises a 26 AWG conductor.

3. The cable of claim 1, wherein each of the first individually insulated conductors comprises a stranded copper conductor.

4. The cable of claim 1, wherein the insulation included in the first individually insulated conductors and the second individually insulated conductors comprises fluorinated ethylene propylene.

5. The cable of claim 1, wherein each of the second individually insulated conductors comprises a 23 AWG conductor.

6. The cable of claim 1, wherein the first shield layers and the second shield layers each comprise:

a dielectric layer; and a continuous layer of aluminum formed on the dielectric layer.

7. The cable of claim 1, further comprising at least one drain wire.

8. A cable, comprising:

a central power delivery component comprising a plurality of shielded first individually insulated conductors, wherein at least one first shield layer provides electromagnetic interference shielding for the first individually insulated conductors;

four twisted pairs of second individually insulated conductors positioned around an outer periphery of the central component and stranded with the central component, respective second shield layers formed around each of the four pairs of second individually insulated conductors; and a jacket formed around the central component and the four twisted pairs, wherein the cable is capable of transmitting data within an operating frequency range of up to 2.5 GHz over a distance of at least 100 m.

9. The cable of claim 8, wherein the plurality of shielded first individually insulated conductors comprises at least one twisted pair of first individually insulated conductors, and wherein the at least one first shield layer comprises a respective first shield layer formed around each twisted pair included in the at least one twisted pair of first individually insulated conductors.

10. The cable of claim 8, wherein each of the first individually insulated conductors comprises a 26 AWG conductor.

11. The cable of claim 8, wherein each of the first individually insulated conductors comprises a stranded copper conductor.

12. The cable of claim 8, wherein the insulation included in the first individually insulated conductors and the second individually insulated conductors comprises fluorinated ethylene propylene.

13. The cable of claim 8, wherein each of the second individually insulated conductors comprises a 23 AWG solid copper conductor.

14. The cable of claim 8, wherein the at least one first shield layer and the second shield layers each comprise:

a dielectric layer; and a continuous layer of aluminum formed on the dielectric layer.

15. The cable of claim 8, wherein an outer diameter of the cable is less than 8.5 mm.

16. A cable, comprising:

a power delivery component comprising a plurality of shielded first individually insulated conductors, wherein at least one first shield layer provides electromagnetic interference shielding for the first individually insulated conductors;

four twisted pairs of second individually insulated conductors, each of the second individually insulated conductors comprising a solid electrically conductive material;

respective second shield layers formed around each of the four pairs of second individually insulated conductors; and a jacket formed around the power delivery component and the four twisted pairs, wherein the cable is capable of transmitting data within an operating frequency range of up to 2.5 GHz over a distance of at least 100 m.

17. The cable of claim 16, wherein the four twisted pairs are positioned around the power delivery component and stranded with the power delivery component.

18. The cable of claim 16, wherein the plurality of shielded first individually insulated conductors comprises at least one twisted pair of first individually insulated conductors, and wherein the at least one first shield layer comprises a respective first shield layer formed around each twisted pair included in the at least one twisted pair of first individually insulated conductors.

19. The cable of claim 16, wherein the insulation included in the first individually insulated conductors and the second individually insulated conductors comprises fluorinated ethylene propylene.

20. The cable of claim 16, wherein an outer diameter of the cable is less than 8.5 mm.

* * * * *